United States Patent [19]

Schedele

[11] 4,302,742

[45] Nov. 24, 1981

[54] ELECTROMAGNETIC RELAY WITH HIGH CONTACT RATING AND IMPROVED INSULATION

[75] Inventor: Helmut Schedele, Hoegling, Fed. Rep. of Germany

[73] Assignee: Siemens Aktiengesellschaft, Berlin & Munich, Fed. Rep. of Germany

[21] Appl. No.: 121,424

[22] Filed: Feb. 14, 1980

[30] Foreign Application Priority Data

Mar. 30, 1979 [DE] Fed. Rep. of Germany ..... 2912800

[51] Int. Cl.[3] ..... H01H 45/02

[52] U.S. Cl. ..... 335/202; 335/135

[58] Field of Search ..... 335/202, 203, 135, 128, 335/133

[56] References Cited

U.S. PATENT DOCUMENTS 3,516,035 6/1970 Josenhans ..... 335/202

3,668,578 6/1972 Schroeder ..... 335/202

FOREIGN PATENT DOCUMENTS 1514612 8/1969 Fed. Rep. of Germany ..... 335/202

1589755 5/1970 Fed. Rep. of Germany ..... 335/202

2728509 4/1979 Fed. Rep. of Germany .

*Primary Examiner*—Harold Broome

*Attorney, Agent, or Firm*—Hill, Van Santen, Steadman, Chiara & Simpson

[57] ABSTRACT

An electromagnetic relay having a high contact rating having an armature and yoke movable by the magnetic coil is provided with an insertable internal member having a vertical wall which divides the interior of the relay into a first portion containing the magnetic coil, armature and yoke, and a second portion containing the contact elements and a slidable member for transmitting movement. The insertable member has a second vertical wall perpendicular to the dividing wall which is provided with a slot for receiving the slidable member to permit movement of the member between the two portions of the relay interior. In order to further increase the insulation between the yoke and a stationary contact member, the stationary contact member is provided with a trapezoidal recess which receives a correspondingly shaped projection of the dividing wall which is interposed between the stationary contact element and the slidable member.

4 Claims, 5 Drawing Figures

ELECTROMAGNETIC RELAY WITH HIGH CONTACT RATING AND IMPROVED INSULATION

BACKGROUND OF THE INVENTION

1. Field of the Invention

The present invention relates to electromagnetic relays, and in particular electromagnetic relays having a high contact rating and having a central movable contact which makes and breaks with two opposed stationary contacts.

2. Description of the Prior Art

Electromagnetic relays in which an armature and yoke assembly is actuated by an electromagnetic coil and plunger system are known in the art, as described in German Offenlegungsschrift No. 2,728,509. It is a problem in the design of relays of this type to eliminate or substantially minimize current leakage paths between the contact elements of the relay and any connections to ground. This design problem becomes more acute as the switching currents with which the relay is to be used increase. A particularly difficult leakage path to eliminate is that which results from the yoke which must necessarily engage both the magnetic system and at least one of the contacts.

One solution to the problem in the past has been simply to increase the size of the relay, thus increasing all internal distances thereby increasing the resistance and insulating properties of whatever gas is utilized to fill the interior of the relay. Evacuation of the interior of the relay is also utilized, however, if the relay is subjected to a substantial shock the vacuum seal is frequently broken, and the seal will generally deteriorate even in the absence of shock after a period of use.

A further solution is described in German Offenlegungsschrift No. 2,728,509 in which a central movable contact element is provided with an extension which engages a slidable element movable by the magnetic system. This structure, however, results in a relatively poor efficiency of the magnetic system and is thus not completely satisfactory.

SUMMARY OF THE INVENTION

It is an object of the present invention to provide an electromagnetic relay having a high contact rating and which has a central movable contact element with an assembly for moving the contact element which engages the contact element between its contract and its mount, with an insertable member to minimize leakage paths between the contact elements and any ground connection.

It is a further object of the present invention to provide such a relay with an insertable member which shields a fixed contact element from the yoke which is utilized to move the movable contact element. It is another object of the present invention to provide such a relay with an insertable member which prevents arcing between the magnetic system and the contact element assembly.

In accordance with the present invention, the above objects are achieved by an insertable member having a vertical wall which divides the interior of the relay into a portion containing the magnetic system, including the armature and a portion of the yoke, and a second portion which contains the contact element assembly. The insertable member is provided with a slot in a side wall thereof which slidably engages a member to permit movement between the two portions of the relay interior.

The wall which divides the relay interior into the two portions is further provided with a trapezoidal extension which is received in a correspondingly shaped receptacle in one of the fixed contact elements so that insulating material comprising the projection is interposed between the fixed contact element and the slidable member to increase the resistance of the potential leakage path resulting from engagement of the yoke with the contact assembly and the magnetic system.

DESCRIPTION OF THE PREFERRED EMBODIMENTS

Figures 1, 2, 3, 4:
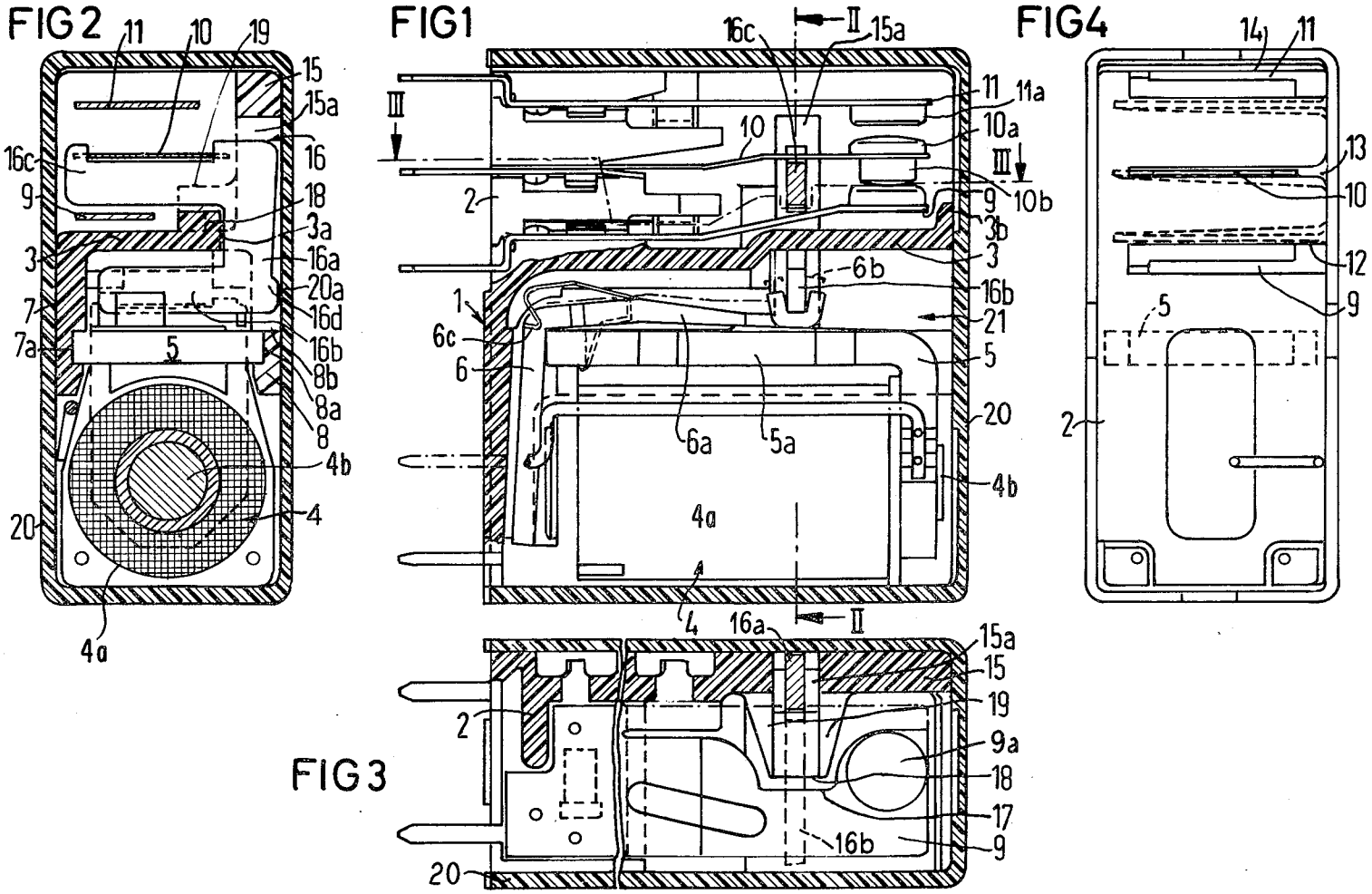
FIG. 1 is a sectional view of a relay with an insertable insulating member constructed in accordance with the principals of the present invention.
FIG. 2 is a sectional view taken along line II—II of FIG. 1.
FIG. 3 is a sectional view taken along line III—III of FIG. 1.
FIG. 4 is a plan view of the base of the relay of FIG. 1.

An electromagnetic relay capable of operation in a high-current environment is illustrated in FIG. 1. The relay operates according to the known spring-armature principle. The relay is provided with an insertable member generally referenced at 1 which is comprised of insulating material such as, for example, polyphenylene sulfide. The insertable member 1 has a base portion 2 and a vertical wall 3. The vertical wall 3 divides the interior of the relay into two essentially noncommunicating portions. A first portion contains the magnetic system 4, which is a coil-and-plunger system of the type well known in the art, having a coil **4*a* and a plunger 4*b*. The first portion further contains a movable armature 6 having an armature leg 6*a* which engages a leg 5*a* of a movable yoke 5 connected to the plunger 4*b*. The armature 6 is movable from the position shown in the solid lines of FIG. 1 to the position shown at 6*b* in the dashed lines of FIG. 1 by raising the plunger 4*b* by suitable operation of a coil 4*a*, which in turn lifts the yoke 5 permitting a bias spring 6*c* to move the armiture 6**.

Figure 5:
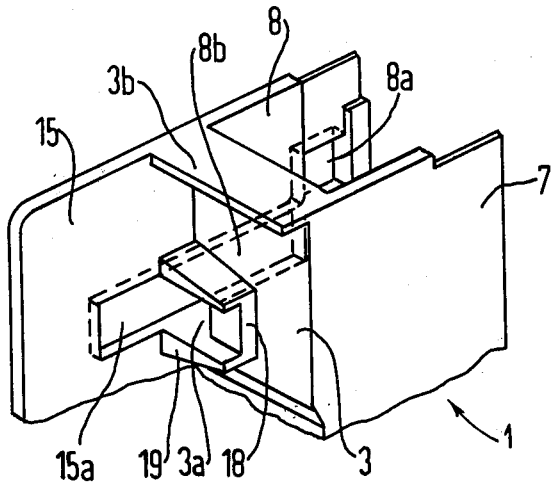
FIG. 5 is a perspective view of a portion of the insertable member utilized in the relay of FIG. 1.

A pair of lateral parallel opposed walls 7 and 8 are integrally formed perpendicular to the vertical wall 3 and, as best shown in FIG. 5, respectively have receptacles **7*a* and 8*a* for receiving opposite ends of the yoke leg 5*a*. The walls 7 and 8 are of sufficient flexibility to allow the yoke leg 5*a* to be forcibly inserted in the receptacle 7*a* and 8*a***.

The remaining portion of the relay interior which is formed by the vertical wall 3 contains the contact elements. In the embodiment shown in FIG. 1, the relay consists of opposed fixed contact elements 9 and 11 and a central movable contact element 10 between the elements 9 and 11. The contact elements 9, 10 and 11 are respectively received in notches 12, 13 and 14 in the base portion 2 and are fastened thereto by any suitable means. The contact elements are leaf springs. The central contact element 10 has a contact **10*b* thereon movable into abutment with a contact 9*a* on the contact element 9, as well as a contact element 10*a* movable into abutment with a contact 11***a* carried on the contact element 11.

Movement of the central contact element 10 is achieved by movement of a U-shaped slidable member 16 which has a connecting center section 16*a* joined to parallel legs 16*b* and 16*c*. One edge of the leg 16*b* engages the armature leg 6*a* for comovement therewith. The other leg 16*c* engages the contact element 10 so that when the slidable member 16 is moved by the armature 6 which is displaced by the cooperative movement of the yoke 5 and the plunger 4*a* and the operation of the bias spring 6*c*, a corresponding movement will be imparted to the contact element 10.

The slidable member 16 is received in a lateral slot 15*a* in a wall 15 which comprises a portion of the insertable member 1 and which is disposed in the same plane as the lateral wall 8 perpendicular to the dividing vertical wall 3. Further insulation is provided by a cover 3*b* joined to the top portions of the walls 3 and 15. The lateral wall 8 contains a slot 8*b* in registry with the slot 15*a* so as to permit slidable movement of the element 16 between the two portions of the interior of the relay formed by the vertical wall 3.

In order to increase the insulation of potential leakage paths between the yoke leg 5*a* and the stationary contact element 9, the contact element 9 is provided with a trapezoidal recess 17, as shown in FIG. 3, which receives a projection 18 integrally formed on the vertical wall 3. The projection 18 has opposed trapezoidal ribs 19, which are comprised of the same insulating material as the remainder of the insertable member 1, so that the resistance of the path between the contact element 9 and the yoke leg 5*a* is increased by the interposition of one of the ribs 19 as well as the slidable member 16 between the contact element 9 and the yoke leg 5*a*.

The interior elements of the relay are covered with a protective cap or dust cover 20 which is joined to the edges of the base portion 2 of the insertable member 1. As shown in FIG. 2, a lateral wall 20*a* of the cap 20 acts as a further aid to maintaining the slidable member 16 in proper position by means of a tab 16*b* formed on the member 16 which abuts the wall 20*a* and prevents twisting or other misalignment in a plane parallel to the base 2.

As can be seen in FIG. 1, the present structure results in an empty space 21 defined by the cap 20, the vertical wall 3, the lateral walls 7 and 8, the slidable member 16, and the yoke 5. This space may be utilized to contain additional electronic or electro-mechanical elements, such as, for example a mechanical sign-reversing element for the armature, in which case the protective cap 20 could be provided with a window for viewing an extension of the armature leg 5*a* as a display means for designating the switching state of the relay. The space 21 could further be utilized to house a getter to maintain a proper vacuum within the relay or to collect particle debris which may result during continued operation in order to prevent such debris from interfering with the electrical connections between the contact elements.

With the above structure, an insulation resistance of approximately $10^{13}$ ohms can be achieved between insulated materials and a contact rating of approximately $10^5$ operations at 16 amps with a 22 volt DC resistive load can be achieved.

Although modifications and changes may be suggested by those skilled in the art, it is the intention of the inventor to embody within the patent warranted hereon all changes and modifications as reasonably and properly come within the scope of his contribution to the art.

I claim as my invention:

1. In an electromagnetic relay having a coil with a plunger therein, said plunger movable in response to a signal operating said coil, a yoke-and-armature assembly engaging said plunger for co-movement therewith, a movable contact element movable to make and break electrical contact with at least one fixed contact element, said contact elements each having contacting portions, the improvement of: an insulating member an insulating member comprising a base which forms a bottom of said relay, a vertical wall disposed between said magnetic system and said contact elements which divides the interior of said relay into essentially non-communicating portions to prevent arcing therebetween, a lateral wall orthogonal to said vertical wall and said base having a lateral groove therein disposed adjacent said contact elements beneath the contacting portions thereof; and a U-shaped slidable member having a central connecting portion slidably received for lateral movement in said groove and having a first leg perpendicular to said connecting portion engaging said armature and a second leg perpendicular to said central portion engaging said movable contact element, whereby movement of said plunger is transmitted through said yoke-and-armature assembly and said slidable member to move said movable contact element.

2. The improvement of claim 1 wherein said fixed contact element is disposed between said movable contact element and said vertical wall and has a trapezoidal recess therein, and wherein said vertical wall has a trapezoidal projection received in said trapezoidal receptacle to insulate said fixed contact element from said slidable member and said yoke.

3. The improvement of claim 1 wherein said insulating member is further comprised of a pair of opposed parallel lateral walls disposed orthogonally with respect to said vertical wall and said base which form with said vertical wall a U-shaped insulating enclosure for said magnetic system.

4. The improvement of claim 3 wherein said vertical wall, said opposed lateral walls, said armature, and said slidable member define a free space for receiving auxiliary elements within said relay.

* * * * *